United States Patent [19]

Adams

[11] Patent Number: 4,458,615

[45] Date of Patent: Jul. 10, 1984

[54] SUPPORT STRUCTURE FOR A SEWING MACHINE CONVERTIBLE BED EXTENSION

[75] Inventor: Kenneth D. Adams, Madison, N.J.

[73] Assignee: The Singer Company, Stamford, Conn.

[21] Appl. No.: 478,742

[22] Filed: Mar. 25, 1983

[51] Int. Cl.[3] ..... D05B 73/06

[52] U.S. Cl. ..... 112/260

[58] Field of Search ..... 112/260, 259, 176

[56] References Cited

U.S. PATENT DOCUMENTS 1,132,680 3/1915 Onderdonk .

3,344,762 10/1967 Szosfak et al. ..... 112/260

4,204,493 5/1980 Blackwood et al. ..... 112/260

4,314,517 2/1982 Kasahara et al. ..... 112/260

*Primary Examiner*—Henry Jaudon

*Assistant Examiner*—Andrew M. Falik

*Attorney, Agent, or Firm*—Robert E. Smith; Edward L. Bell

[57] ABSTRACT

A bed extension support structure for a sewing machine is disclosed which not only provides for ready removal and replacement of the bed extension but which also permits adjustment of the alignment and registration of the bed extension with respect to the work supporting bed of the sewing machine.

3 Claims, 4 Drawing Figures

SUPPORT STRUCTURE FOR A SEWING MACHINE CONVERTIBLE BED EXTENSION

DESCRIPTION

Background of the Invention

It has long been known in the art of sewing machine construction that two different types of work supporting surfaces may be provided, each best suited to accommodate a different form of work piece; that is, a flat bed best accommodating planar work pieces, and a cantilevered bed, variously referred to as a cylinder bed, free arm or tubular bed, more conveniently accommodating cylindrical work pieces. It is known to provide a tubular bed sewing machine with a bed extension adapted to augment the tubular bed work supporting surface when flat work pieces are to be attached and which is detachable from the sewing machine and must be stored separately when tubular articles are to be sewn.

The present invention pertains to a type of bed extension referred to as "convertible bed" in which work supporting elements may be shifted selectively into parallelism with the tubular bed work supporting surface defining flat bed configuration but which need not be detached from the sewing machine when shifted out of such flat bed mode.

In known convertible bed constructions the work supporting elements are shiftably supported directly on portions of the machine frame which are integral with the tubular bed. As a result, high degree of accuracy is required in manufacture of the frame including costly machining steps and the like, which impair the cost effectiveness of such prior convertible bed constructions.

SUMMARY OF THIS INVENTION

A mounting bracket is provided for supporting a cylinder bed extension relatively to a sewing machine frame with provision for universal adjustment of the cylinder bed extension not only to provide for parallelism with the work supporting surface of the tubular bed, but also to provide for uniform close spacing of the extension adjacent to the tubular bed work supporting surface.

DESCRIPTION OF THE DRAWINGS

With the above and additional objects and advantages in view, as will hereinafter appear, this invention will now be described with reference to a preferred embodiment illustrated in the accompanying drawings in which.

DESCRIPTION OF THE INVENTION

Figure 2:
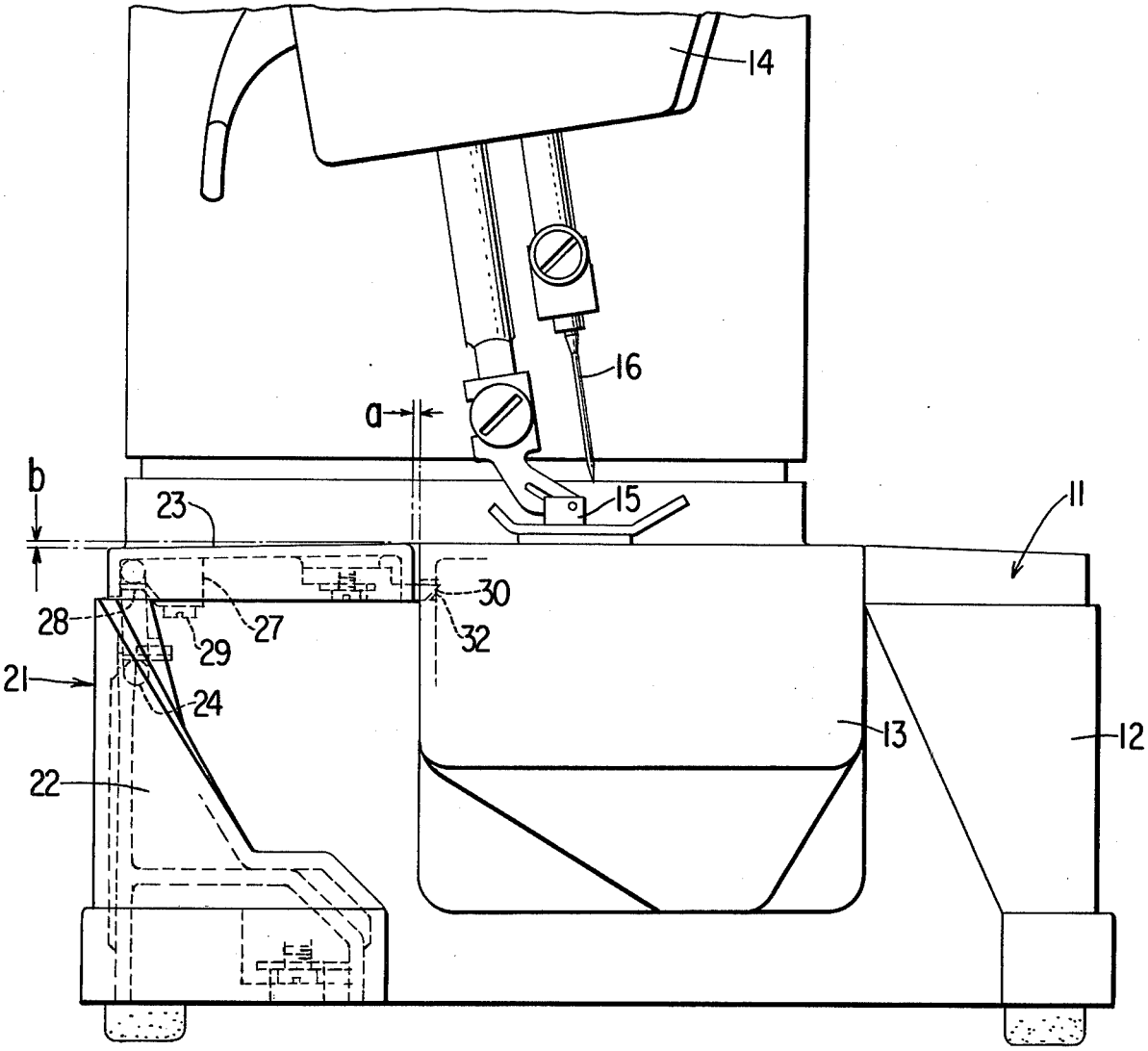
FIG. 2 is an end elevational view of the sewing machine bed bracket, and convertible bed extension of FIG. 1 illustrated in a position in which the extension augments the flat bed mode.

Referring to the drawing, 11 indicates generally the bed segment of a sewing machine frame which includes a base portion 12 from which a tubular bed portion 13 is cantilevered. As illustrated in FIG. 2, the sewing machine frame may also include a sewing head 14 arranged above the tubular bed and carrying stitch forming instrumentalities such as a presser device 15 and an endwise reciprocating thread carrying needle 16 for cooperation with other stitch forming mechanisms (not shown) in the tubular bed in the formation of stitches.

The tubular bed 13 when not augmented by any lateral extension is ideally suited to accommodate cylindrical work pieces such as sleeves, trouser legs and the like.

Figure 1:
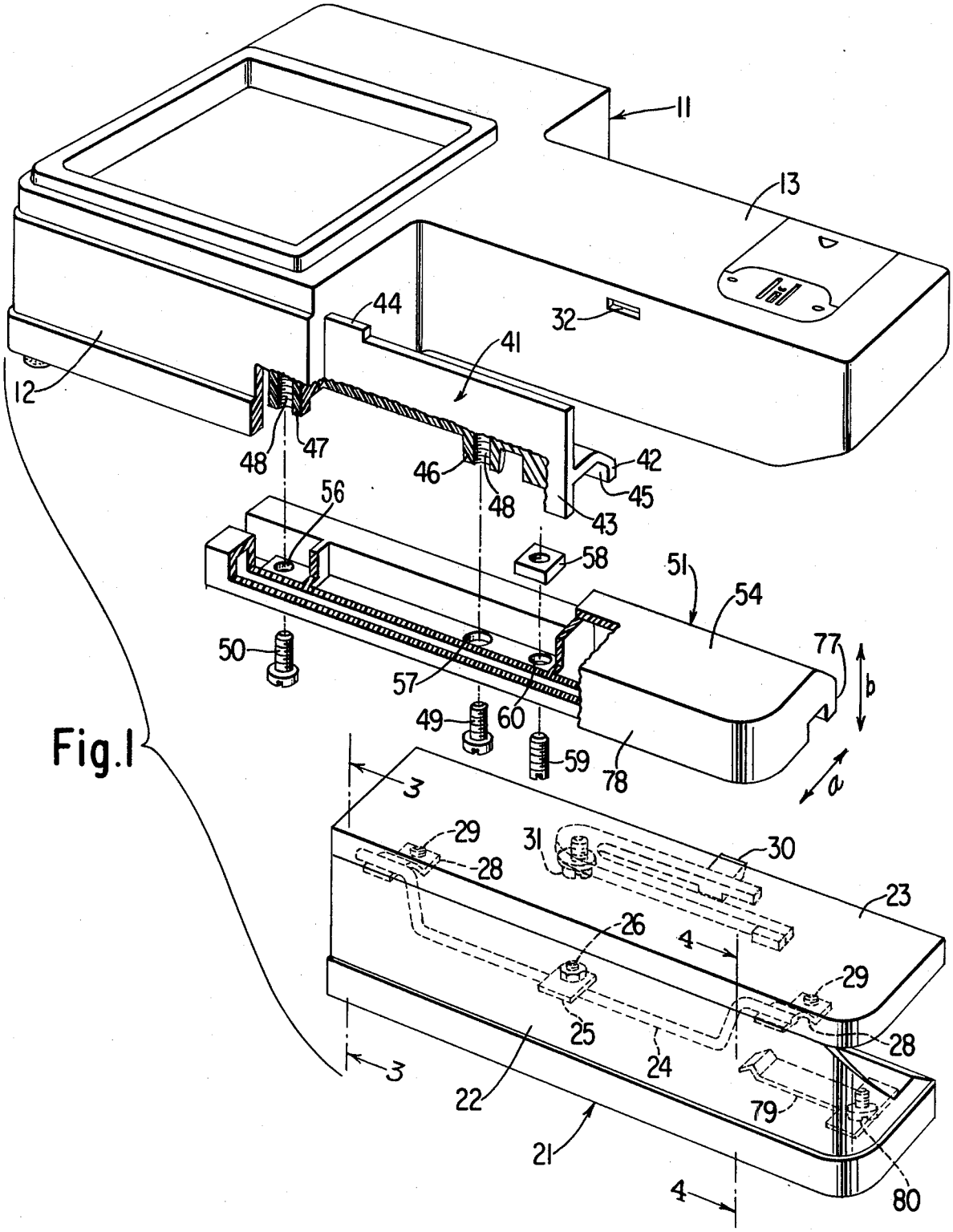
FIG. 1 is an exploded perspective view of a sewing machine bed, a mounting bracket for a convertible bed extension, and the extension with portions of the bed and of the bracket broken away to expose fastening and adjusting means therefore in accordance with this invention.

FIGS. 1 and 2 also illustrate a convertible bed extension device indicated generally at 21 and including a standard 22 to which a bed extension plate 23 is pivotally secured. Although the construction of the pivotal support for the bed extension plate may be of any known form, a preferred form as illustrated in FIGS. 1 and 2 involves the provision of a "U" shaped wire pintle member 24 secured to the standard 22 as by a clamp member 25 and fastening screw 26, with the extremities of the pintle member each being pivotally embraced between a pillow block 27 formed beneath the bed extension plate 23 and a spring clip 28 secured by a screw 29 beneath the pillow block 27.

The bed extension plate 23 as shown in FIG. 2 may include a leaf spring latch 30 secured beneather the bed extension plate by a screw 31 and engageable in a recess 32 in the tubular bed to retain the free edge of the extension plate in raised position contiguous to the work supporting surface of the tubular bed.

Referring to FIG. 1, the means by which the convertible bed device is supported on the sewing machine bed will now be described. Adjacent to the tubular bed 13 and toward the rear thereof, the base portion 12 of the bed is formed with a projection 41. The projection is formed with substantially vertical front and rear surfaces 42 and 43 and at the juncture of the rear surface 42 with the base portion 12 of the bed a raised rectangular block 44 is provided. In a recess 45 formed beneath the projection 41 two spaced cylindrical bosses 46, 47 depend, each formed with a threaded hole 48 for accommodation of respective fastening screws 49 and 50.

Fitted loosely within the recess 45 is a generally rectangular mounting bracket 51 which extends from the projection 41 substantially parallel to the tubular bed 13.

At one extremity the upper surface of the mounting bracket 51 is formed with spaced limbs 52, 53 having height somewhat less than that of a main body portion 54 located at the opposite extremity. Between limbs 52 and 53, a web 55 is formed in which apertures 56 and 57 are arranged, the apertures being aligned, respectively, with the threaded holes 48. The aperture 56 preferrably accommodates the fastening screw 50 snuggly, while aperture 57 is of considerably larger diameter than that of the fastening screw 49 to provide for a degree of rotational adjustment of the mounting bracket 51 about the axis of the fastening screw 50. This clearance between the aperture 57 and fastening screw 49 provides for a degree of horizontal adjustment of the main body portion 54 of the mounting bracket along the path illustrated by the arrow A in FIG. 1 which serves, as will be apparent from the ensuing description, as a means for adjusting the clearance "a" between the bed extension plate 23 and the tubular bed 13 as illustrated in FIG. 2.

Accommodated between the limbs 52 and 53 of the mounting bracket 51 and above the web 55 thereon is a threaded nut 58 into which a set screw 59 is threaded. The set screw passes through a clearance hole 60 in the web 55 so that it is accessible from beneath. The set screw 59 by being turned to bear more or less against the underside of the recess 45 in the projection 41 regulates the extent to which the web 55 may be drawn toward the boss 46 by the fastening screw 49. Stated otherwise, the set screw 59 influences a vertical adjustment of the free extremity of the mounting bracket 51 about the location of the fastening screw 50 along a path illustrated by the arrow B in FIG. 1. This adjustment serves, as will be apparent from the ensuing description as a means for minimizing any difference "b" in elevation as between the bed extension plate 23 and the tubular bed 13, as shown in FIG. 2.

The convertible bed extension device indicated generally at 21 may be rigidly attached by any conventional means to the mounting bracket 51 as to partake of the positional adjustment thereof. A preferred form of interengagement is illustrated in the drawings which provides for ready removal of the bed extension device so that in its place any one of a variety of ancillary attachments such as work shifting embroidery attachments, buttonhole attachments and the like (not shown) may be inserted.

In accordance with the preferred form of the interengagement between parts, the standard 22 of the convertible bed device is made hollow so as slidably to accommodate both the projection 41 and the mounting bracket 51 within its interior.

Figure 3:
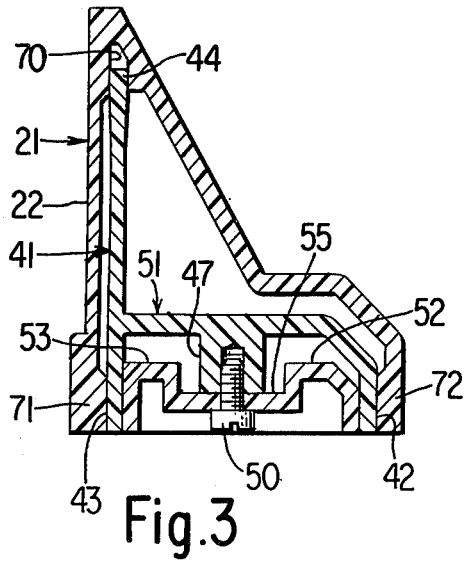
FIG. 3 is a cross-sectional view of the assembled bed, mounting bracket, and bed extension taken substantially along line 3—3 indicated on the bed extension shown in FIG. 1.
Figure 4:
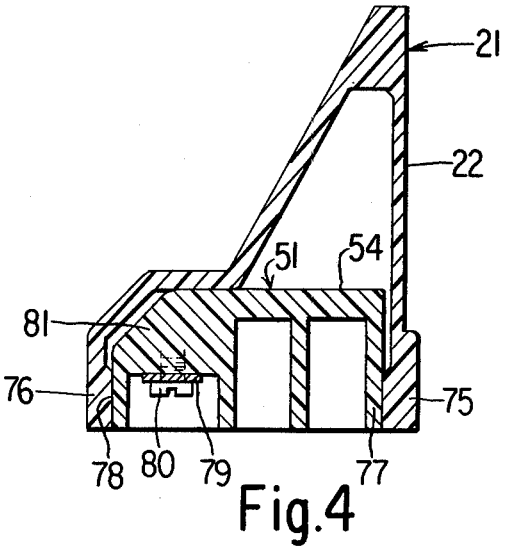
FIG. 4 is a cross-sectional view of the assembled mounting bracket and bed extension taken substantially along line 4—4 indicated on the bed extension shown in FIG. 1.

Referring to FIGS. 3 and 4, which show the cross-sectional relationship of parts adjacent to the inboard and outboard extremities of the convertible bed device, respectively, the preferred form of interengagement between parts will be described.

As shown in FIG. 3, the interior of the standard 22 of the convertible bed device is formed with a narrow recess 70 into which the rectangular block 44 on the projection 41 is snuggly accommodated. The block 44 is preferably enlarged slightly to provide localized contact between the parts; although the recess 70 might be constricted to provide the same results.

At the lower edges, the walls of the standard 22 are thickened inwardly as at 71 and 72 to provide localized contact with the front and rear surface 42 and 43 of the projection 41. Since the points of localized contact between the standard 22 and the projection 41 are located adjacent to the fastening screw 50 about which all movement of the mounting bracket 51 occurs, a minimum of interference will arise should the position of the mounting bracket have to be adjusted. The three spaced points of localized contact 70, 71 and 72 provide for maximum constraint against tilting of the convertible bed device about an axis parallel to its length.

At the outboard extremity of the convertible bed device, as shown in FIG. 4, the walls of the standard 22 are thickened inwardly as at 75 and 76 to provide localized contact with front and rear sidewalls 77 and 78, respectively, of the main body portion 54 of the mounting bracket. A spring retainer 79 secured as by a screw 80 beneath the standard 22 engages a web 81 formed beneath the main body portion 54 of the mounting bracket to maintain the standard and mounting bracket interengaged as shown in FIGS. 2 and 4, and also to deter accidential disengagement of the convertible bed device from the mounting bracket.

When the bed extension plate 23 is raised and retained by seating of the spring latch 30 in recess 32 to maintain such raised position augmenting the work supporting surfaces of the tubular bed, the spring latch 30 will also further deter removal of the convertible bed device from the mounting bracket.

It is understood that the present disclosure relates to a preferred embodiment of the invention which is for purposes of illustration only, and that various modifications may be made therein without departing from the spirit and scope of the invention as defined in the appended claims.

I claim:

1. In a sewing maching having a frame formed with a supporting base and an elongate tubular work supporting bed with a substantially planar work supporting surface extending from said supporting base, a bed extension plate having a substantially planar work supporting surface adapted to be sustained in an operative position adjacent to said tubular work supporting bed, a mounting bracket for said bed extension plate, means for securing said bed extension plate in predetermined orientation relatively to said mounting bracket, and fastening means for securing said mounting bracket to said supporting base with capacity for universal adjustment, said fastening means comprising, spaced threaded bosses formed on said supporting base in alignment generally parallel to said elongate tubular work supporting bed, fastening screws one threadedly engaging each of said threaded bosses, said mounting bracket formed with a snug aperture for one of said fastening screws to define about said one fastening screw pivotal axes for adjustment of said mounting bracket in mutually perpendicular directions, for influencing in one direction the proximity of said bed extension plate to said tubular work supporting bed and in the other direction for influencing a coplanar relationship of bed extension plate and tubular work supporting bed surfaces, said mounting bracket formed with a clearance aperture for the other of said fastening screws providing for adjustment of said mounting bracket in one direction, and a set screw associated with said mounting bracket adjacent to one of said fastening screw apertures for engagement with said supporting base to limit the proximity of said mounting bracket to the boss into which said last mentioned fastening screw is threaded providing for adjustment of said mounting bracket in the other direction.

2. A bed extension arrangement for a sewing machine with a tubular work supporting bed as set forth in claim 1 in which, a standard is provided to which said bed extension plate is hingedly connected for selective pivotal movement into and out of said operative position adjacent to said tubular work supporting bed, latch means effective between said bed extension plate and said tubular work supporting bed to maintain said bed extension plate in operative position, said means for securing said bed extension plate in predetermined orientation relatively to said mounting bracket including interengaging surfaces formed on said mounting bracket and on said standard, said interengaging surfaces being separable only when said latch means is disengaged.

3. A bed extension arrangement for a sewing machine with a tubular work supporting bed as set forth in claim 2 in which, said means for securing said bed extension plate in predetermined orientation relatively to said mounting bracket also includes interengaging surfaces formed on said standard and on said sewing machine supporting base closely adjacent to that one of said threaded bosses into which is threadedly engaged the fastening screw passing through said snug aperture in said mounting bracket.

* * * * *